United States Patent [19]

Hesch

[11] Patent Number: 5,010,825

[45] Date of Patent: Apr. 30, 1991

[54] RAIL CAR END ASSEMBLY

[75] Inventor: Harold E. Hesch, St. John, Ind.

[73] Assignee: Trinity Industries, Inc., Dallas, Tex.

[21] Appl. No.: 508,365

[22] Filed: Apr. 11, 1990

Related U.S. Application Data

[63] Continuation of Ser. No. 352,715, May 12, 1989, Pat. No. 4,944,234, which is a continuation of Ser. No. 65,948, Jun. 24, 1987, abandoned.

[51] Int. Cl.[5] ..... B61D 17/06

[52] U.S. Cl. ..... 105/378; 49/449

[58] Field of Search ..... 105/378, 410; 49/40, 49/41, 395, 449; 410/26, 27, 4

[56] References Cited

U.S. PATENT DOCUMENTS

| | | | |
|---|---|---|---|
| 2,232,026 | 2/1941 | Gober | 49/449 X |
| 2,824,339 | 2/1958 | Shaver | 105/378 X |
| 3,181,903 | 5/1965 | Olander | 105/378 |
| 3,827,184 | 8/1974 | Pennec et al. | 49/449 |
| 3,828,693 | 8/1974 | Kampman et al. | 105/378 |
| 3,995,563 | 12/1976 | Blunden | 105/378 |
| 4,077,330 | 3/1978 | Peisner et al. | 105/378 X |
| 4,084,516 | 4/1978 | Ravani et al. | 105/378 X |
| 4,318,349 | 3/1982 | Galasan | 105/378 |
| 4,437,410 | 3/1984 | Stoller, Sr. et al. | 105/378 |
| 4,649,831 | 3/1987 | Burleson | 105/378 |

*Primary Examiner*—Margaret A. Focarino
*Assistant Examiner*—Dean J. Kramer
*Attorney, Agent, or Firm*—Myers & Associates, Ltd.

[57] ABSTRACT

A rail car end assembly comprises upper and lower tracks for guiding and stabilizing multi-panel doors moving between open and closed positions. End posts are located inside the car and spaced inwardly from respective side wall end portions. The doors pass between the space between the end posts and the side wall end portion when moved into the open position. A latch arrangement is provided which latches the door in the open and closed positions. The latch arrangement includes a lower pin engaging a keeper adjacent the lower track, and an upper pin engaging a keeper supported on an elevated platform in the car. The pins are joined by a cable for synchronous movement to lock and to release the doors. Each door has a follower engaging the upper track for guiding the door. In the closed position, the follower engaging a stop on the track which reinforces the upper portion of the door against outward movement. The upper end of each door is pivotally connected on a vertical axis adjacent its inner edge to one end of a stabilizing arm the other end is pivotally connected on a vertical axis to the car.

9 Claims, 6 Drawing Sheets

9
10
10
10
20
22
18
52
52
56
56
50
50
64
64
125
125
44
44
46
46
42
42
38
38
32
32
122
122
128
128
54a
54
54
6
6
57
57
110
110
96
96
98
54d
54d
54c
54c
114
114
112
112
28
28
8
8
57
57
114
114
84
118
16
54b
54b
68
68
60
60
60
60
58
58
78
80

50
20
57
54c
111a
111b
111c
98
110
6
111d
108
104
103
99
96
100
108
120
116
112
84
112
116
80
86
118
54b
82
78
74
76
90
93
68
60
88
92
72
58
62

RAIL CAR END ASSEMBLY

This application is a continuation of our pending U.S. application Ser. No. 07/352,715, filed May 12, 1989, now U.S. Pat. No. 4,944,234 which is a continuation of U.S. application Ser. No. 07/065,948, filed June 24, 1987, which is abandoned. U.S. application Ser. No. 07/352,715 is incorporated herein by reference.

BACKGROUND OF THE INVENTION

1. Field of the Invention

This invention pertains to rail car end closures protecting the car against unauthorized entry and undesirable movement of objects contained in the car, and more particularly relates to a two door arrangement of the end closure.

2. Description of the Prior Art

The prior art is replete with various end closures for a railway car. For example, U.S. Pat. No. 3,995,563 discloses an end closure comprising two sliding doors which move between closed and open positions. Upon opening of the doors, each door moves into an open space on the outer side of the rail car through a vertical opening in the side wall. Each door includes an arcuate laterally outer portion and a straight laterally inner portion attached tangent to the laterally inner edge of the arcuate portion. Each door is supported to ride on an arcuate track having the same radius of curvature as the arcuate portion of the door. The door is supported on the track by rollers attached solely to the arcuate portion.

The opening in the side wall provides an undesirable degree of access to the interior of the rail car from outside, placing the contents of the rail car in jeopardy of damage from vandalism and other outside forces. In addition, support of the door on rollers only on the arcuate portion results in a relatively weak support of the laterally inward portions of the doors.

The extension of the door through the side wall presents problems with respect to support of the required ladder at the end of the car. In the prior art, the ladder is supported by a brace beam connected to its top end. Because the door is taller than the height of the brace beam, a slot is cut in the door to allow it to open. This slot weakens the laterally outward upper corner of the door, which may be bent back to gain access to the interior of the car.

SUMMARY OF THE INVENTION

The subject invention eliminates movement through vertical opening in the side wall. The arcuate portion of the door is also eliminated. The assembly provides a door stabilizing arrangement via top and bottom tracks, and also provides a door locking system.

The rail car end assembly of the present invention comprises a pair of substantially straight and continuous solid side walls, and a pair of multi-panel doors mounted for movement between open and closed positions along top and bottom tracks. When opened, the doors move into the space between the side walls and remain adjacent the side walls in the open position. The doors are substantially coterminous with the side walls in the open position. The top and bottom tracks guide and stabilize the doors in all door positions. Each door moves through a space defined between an end post located inside the car and a side wall end portion offset laterally outwardly from the end post.

DESCRIPTION OF THE PREFERRED EMBODIMENT

Figure 1:
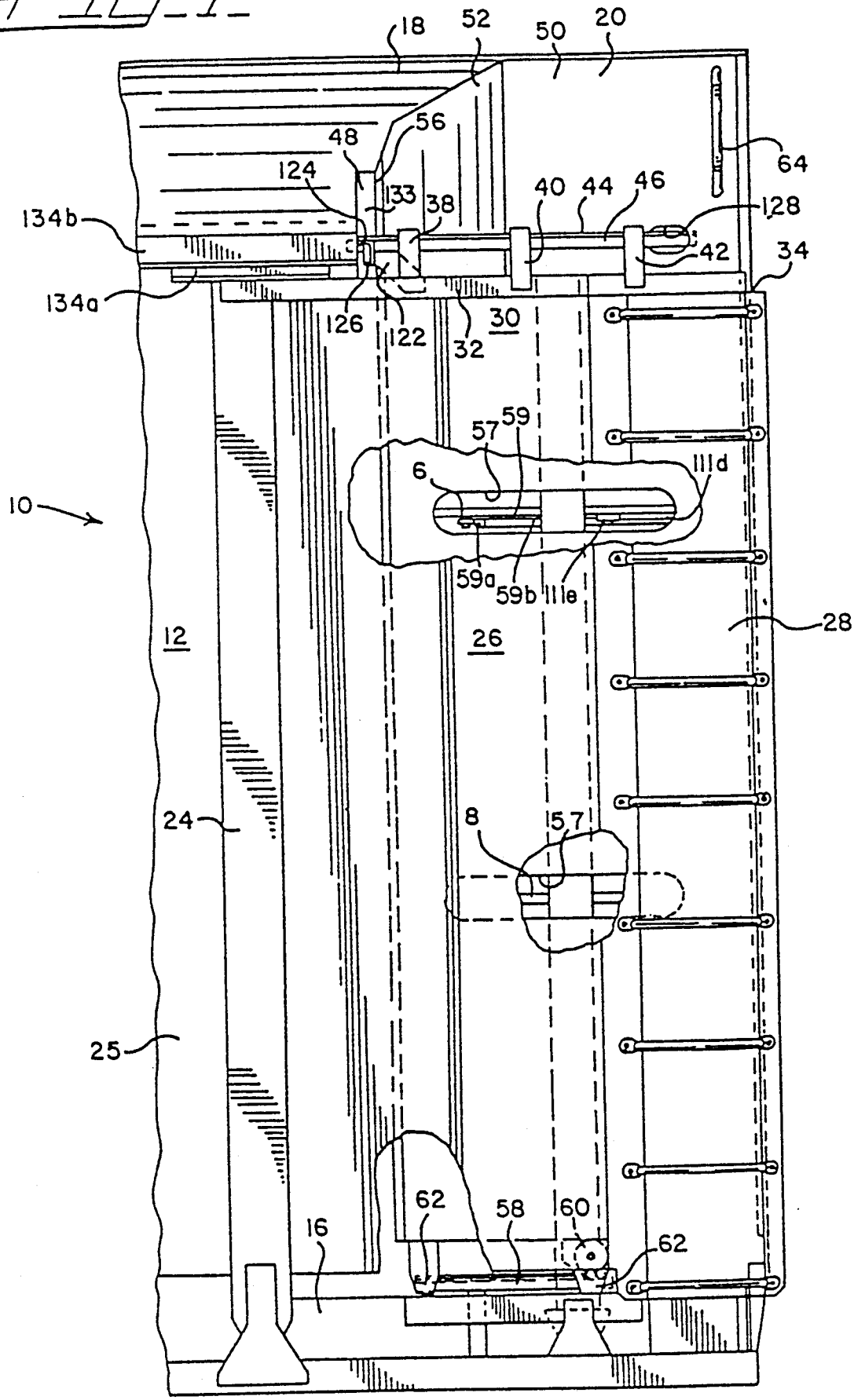
FIG. 1 is a side view of the rail car end assembly of this invention.

Referring to the drawings, wherein reference characters designate corresponding parts throughout the several views, FIGS. 1–7 show a railway car for transporting automobiles on a series of vertically spaced decks 6 and 8. The end assembly generally indicated at 10 comprises a pair of longitudinally extending substantially straight and continuous side walls 12 and 14, a floor 16, a roof 18 and a pair of multi-panel rigid doors 20 and 22. The side wall and door of one side of the railway car are mirror images of those of the other side of the car. Only one side of the end assembly 10 will be described herein, and it will be understood that similar structure is present on the other side of the car.

As shown in FIG. 1, the side wall 12 includes a vertical support post 24. Side wall 12 includes a longitudinally intermediate portion 25 and an end portion 26 connected with the longitudinally outward end thereof. End portion 26 is offset laterally outward from the intermediate portion 25. A ladder 28 is connected to end portion 26 and extends the full height of the wall 12. The ladder 28 enables a worker to climb to the decks 6 and 8. The upper end 30 of the wall end portion 26 is connected with a tubular bar 32 extending from the post 24, above end portion 26 and to the outer edge 34 of the car. Angle-shaped brackets 38, 40 and 42 are mounted on the tubular bar 32 and support an upper track 44. The upper track 44 is angle-shaped in cross section and has a depending flange 46. Upper track 44 is also attached at its longitudinally inner end to a roof supporting structure 48.

In the closed position (see FIGS. 2 and 5), the doors 20 and 22 span the space between the side walls 12 and 14 to substantially cover the entire opening at the longitudinal end of the car. Each of the doors 20 and 22 shown in FIGS. 1, 2, 4 and 5 includes a laterally inner panel 50 rigidly secured to a laterally outer panel 52 at an obtuse angle. In the preferred embodiment, panels 50 and 52 are angulated at approximately 150 degrees with respect to each other.

Figure 2:
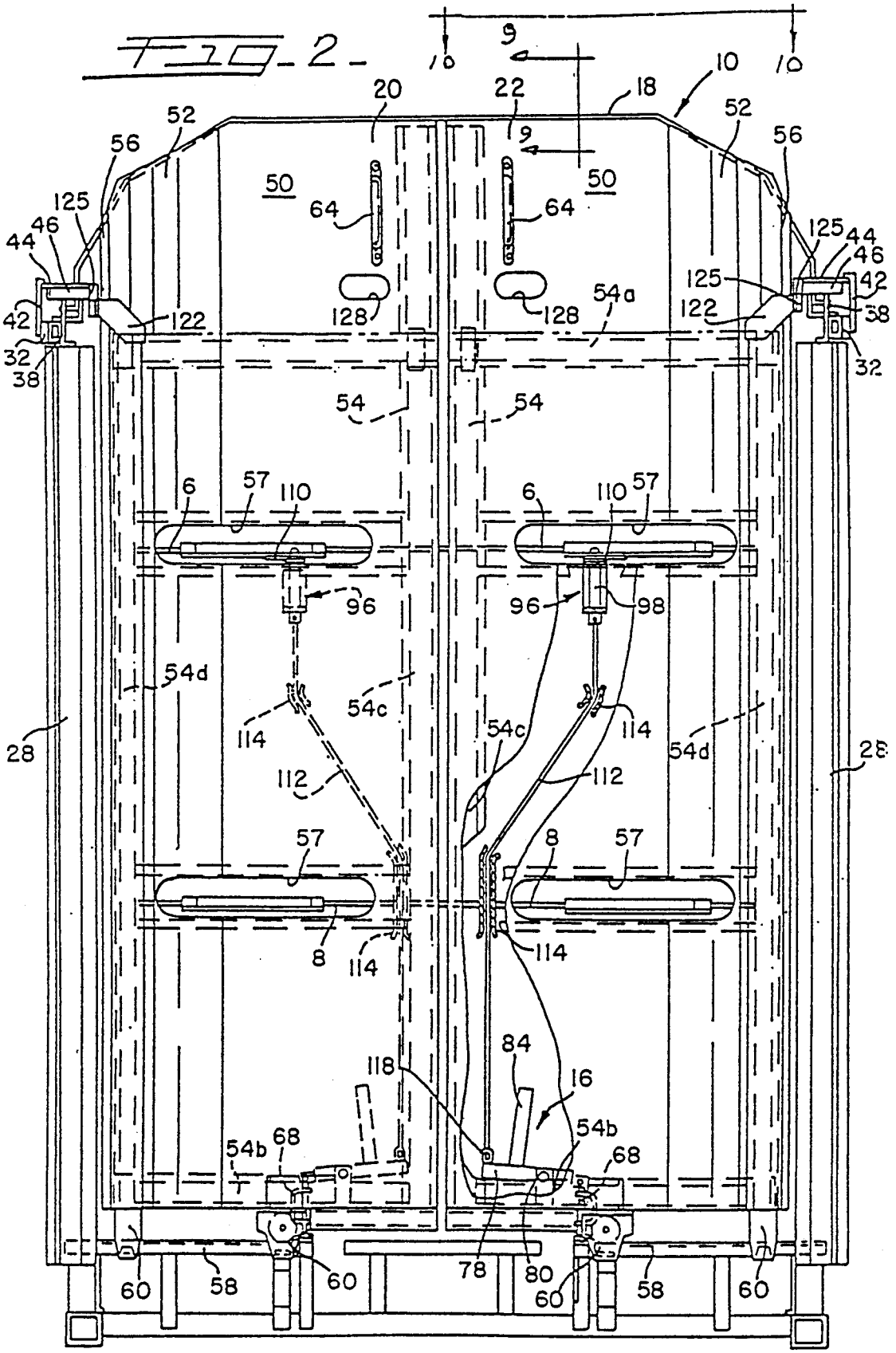
FIG. 2 is a front elevational view of the rail car end assembly.

As best visible in FIG. 2, the doors 20 and 22 are primarily reinforced by door frame 54. Door frame 54 includes upper and lower hat shaped reinforcement members **54*a* and 54*b* each being angled for attachment to inner and outer panels 50 and 52. Door frame 54 also includes vertical reinforcement members 54***c* and 54*d* connected with the inside surfaces of inner panel 50 and outer panel 52 respectively adjacent the edges of the door 20. Vertical reinforcement members 54*c* extend substantially the height of the door 20.

For additional reinforcement of the door 20, an angled flange 56 is provided along the laterally outer edge of outer panel 52. Each of the doors 20 and 22 has a pair of horizontal slots 57 therein which accommodate the ends of bridge plates of parallel decks 6 and 8 which extend partially through the doors 20 and 22.

The doors 20 and 22 ride between open (FIGS. 1 and 4) and closed (FIGS. 2 and 5) positions along respective arcuate bottom tracks 58 and respective arcuate upper tracks 44. Arms 59 are pivotally connected with deck 6 and with vertical members 54*c* to additonally guide the doors 20 and 22 in movement along tracks 58 and 44. Arm 59 has a plate portion 59*a* pivotally supported on platform 6. Plate portion 59*a* extends generally outwardly from the pivotal connection to plateform 6. Arm portion 59*b* is connected with the lower surface of plate portion 59*c* to provide industry standard clearance above platform 8.

Each panel 50 and 52 has a roller assembly 60 depending from the bottom edge of the panel and riding on the bottom track 58. The roller assemblies 60 each include a generally J-shaped member 62 guiding the doors 20 and 22 along the tracks 58 and preventing the door from lifting up or moving laterally a substantial distance from the track 58.

A handle 64 is mounted on the outer surface the inner panel 50 near the top thereof. When the doors 20 and 22 are moved to the open position, handle 64 is in a position to be reached directly above the top rung of ladder 28, and may be used by an operator for balance in movement from the ladder 28 to the upper deck 6.

Figure 3:
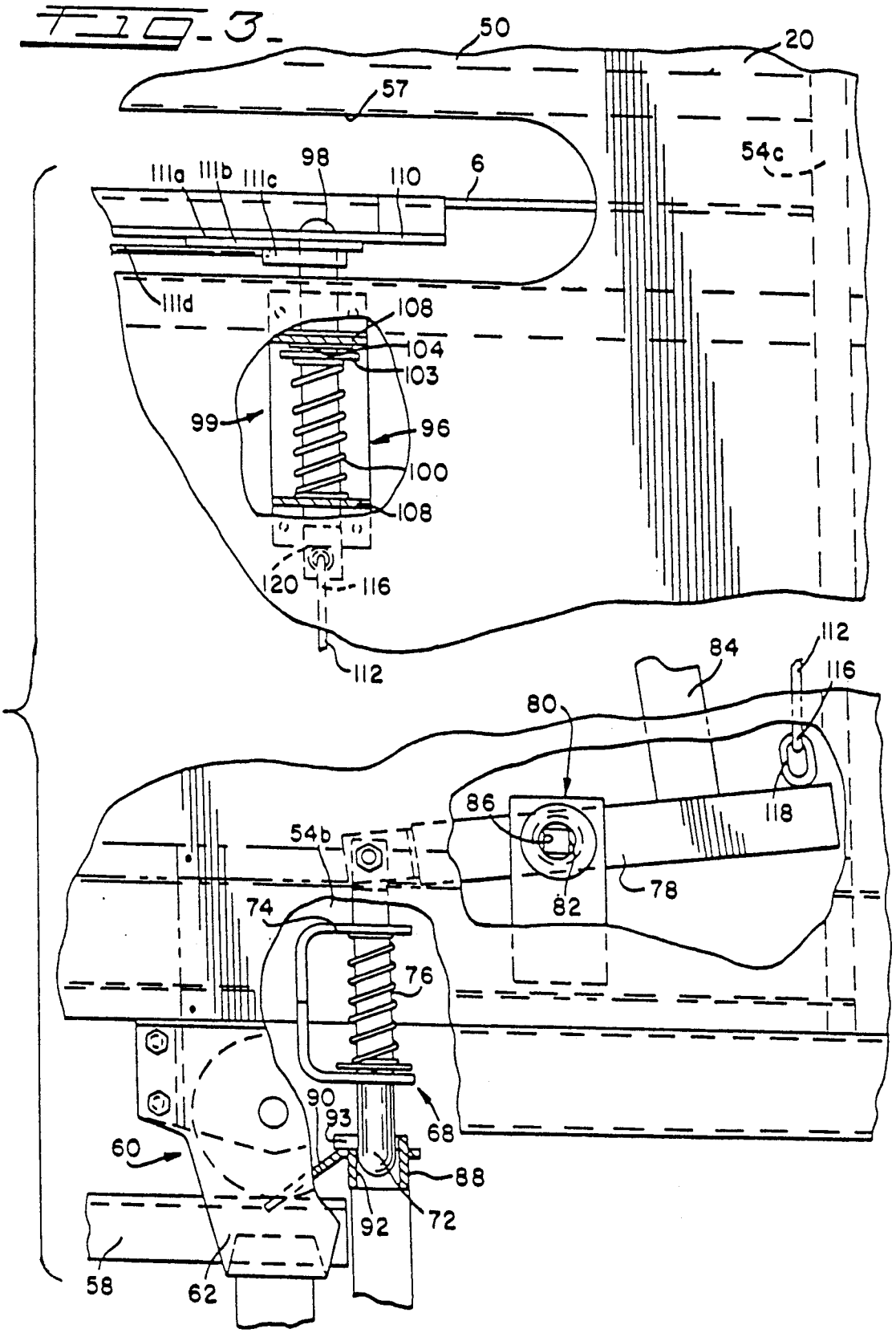
FIG. 3 is a break away view of the door lock mechanism of the end assembly.
Figure 4:
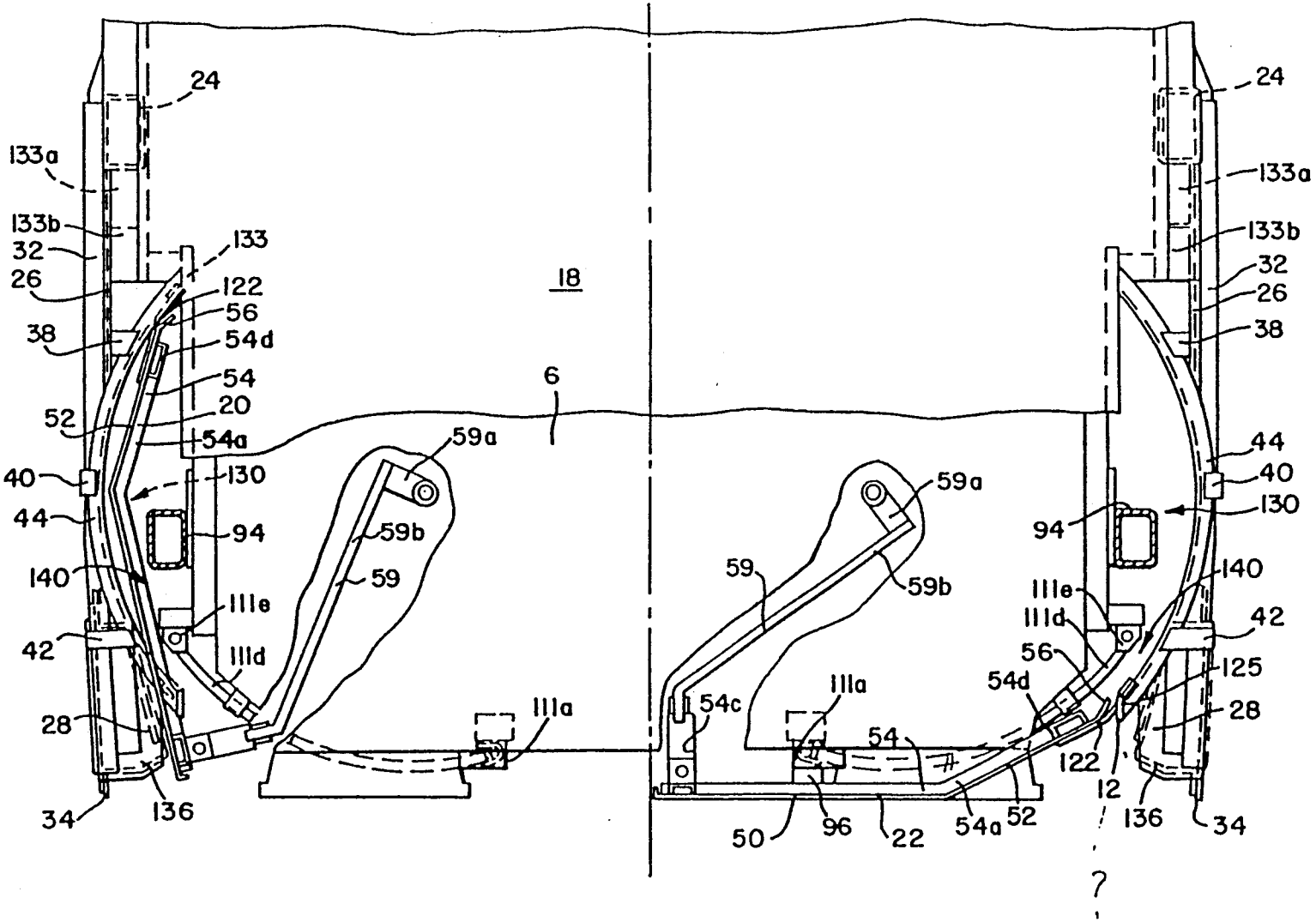
FIG. 4 is a top view of the assembly showing the upper tracks with one door open and one door closed.

As best shown in FIG. 3, a lock mechanism 66 secures the door in closed and open positions. The lock mechanism 66 includes a bottom lock 68 attached to the inner side of the inner panel near the inner panel roller assembly 60. The bottom lock 68 has a spring-loaded bottom pin 72 movably supported extending through the generally parallel walls of a channel-shaped member 74. Channel member 74 is rigidly secured to the inner door panel 50 and houses a compression coil spring 76 which biases the pin 72 to move downwardly. The pin 72 is pivotally connected to a lever 78 at pivotal connection 80. Lever 78 is rotatable about the shaft 82, which projects from the inner door panels 50. Pin 72 may be manually moved upwardly when the door 20 is open, by rotation of lever 78 by moving handle 84 downward. When the door 20 is closed, the lever 78 may be rotated to raise pin 72 by rotation of a crank (not shown) which is inserted into socket 86 mounted on lever 78.

Figure 5:
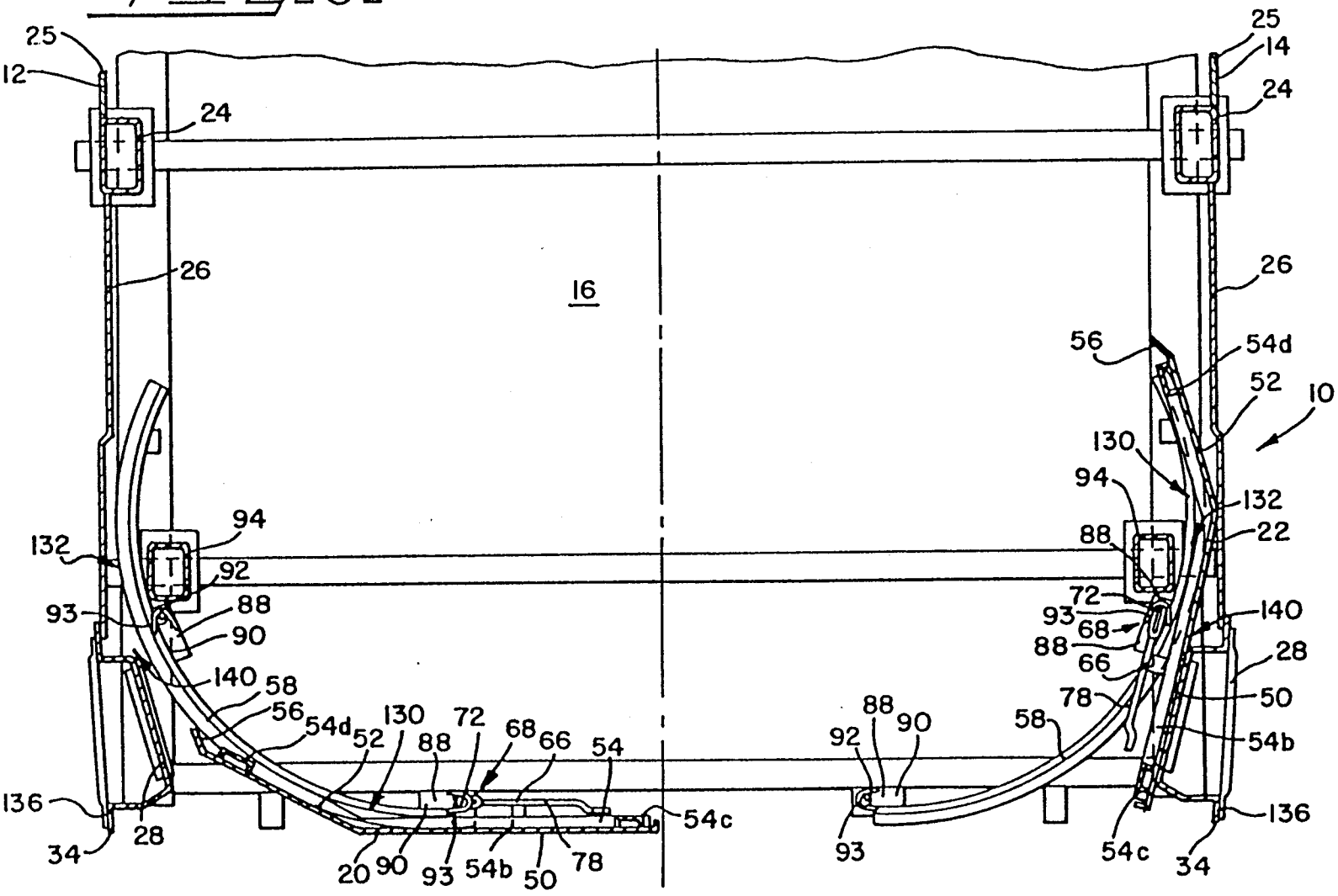
FIG. 5 is a top view of the assembly showing the doors in open and closed positions.

As best visible in FIG. 5, during movement of the door 20 between open and closed positions, the bottom pin 72 is carried on the door adjacent the bottom track 58 until it contacts one of two floor-mounted keepers 88 provided for each door. Each keeper includes an upwardly sloping metal ramp 90 which guides the pin 72 to a pin well 92. A protective collar 93 surrounds the well 92. The pin 72 drops into the well 92 and thereby retains the door in a fixed position. The keepers 88 can be located at desired locations. In the subject embodiment, the keepers 88 are located near the vertical end posts 94 and at the laterally inward end of each bottom track 58. Intermediate the keepers 88, pins 72 are carried spaced radially inward from the arcuate track 58 and have no contact with any part of the car except the door, thereby avoiding friction during movement of the door between the open and closed positions.

An upper lock 96 of the lock mechanism 66 secures the door to the upper deck 6. The upper or platform lock 96 includes a vertical pin 98 supported for vertical movement on a structure 99 mounted on the door. Pin 98 is biased to move upwardly by a compression coil spring 100 through which the pin 98 extends. The structure 99 carrying the pin 98 includes a pair of spaced generally horizontal flanges 108 having openings therein receiving pin 98. Spring 100 engages the lower flange 108 and supports plate 103 secured against upward movement with respect to pin 98 by securement pin 104. A platform keeper structure generally indicated at 110 is supported on the platform 6, to retain the pin 98, when the door is closed, thereby fixing the door against movement. Keeper structure 110 includes mounting portion 111*a* mounted on the platform 6. Plate 111*b* is affixed to the lower surface of mounting portion 111*a*. Both mounting portion 111*a* and plate 111*b* have openings therein receiving pin 98 when the door is locked in the closed position. Guide 111*c* is similar in structure to guide 93 on the lower keeper 88, and is fixed on the lower surface of plate 111*b* to guide pin 98 to the opening therein as the door is moved to the closed position.

Arcuate track 111*d* is connected with plate 111*b* and platform 6. Track 111*d* provides a downward facing surface which pin 98 rides during movement of the door between the open and closed postions. The outer end of track 111*d* is connected with keeper plate 111*e* which receiver pin 98 for locking the door in the open position.

Both top and bottom locks are connected by a flexible link or a cable 112 running through guides 114. The cable 112 has eyelets 116 secured to a ring 118 on lever 78 and in an aperture 120 in upper locking pin 98.

As the door is moved into the closed position, lower lock pin 72 contacts the ramp 90 of lower keeper 88. As the door continues to move, the ramp 90 cammingly elevates lower lock pin 72. The elevation of lower lock pin 72 is transmitted through pivot 80 to lever 78, which is rotated in a clockwise direction about shaft 82. This rotation draws ring 118 downward along with cable 112. Cable 112 draws upper lock pin 98 downward, allowing pin 98 to pass below plate 111*b*. When lower lock pin 72 reaches the opening in keeper 88, the biasing force of spring 76 moves lower lock pin 72 downward into the opening in keeper 88, and upper lock pin 98 is raised by spring 100 to enter the opening in upper keeper structure 110.

The keeper 88 at outward end of bottom track 58 function similarly to keeper 88 at the inward end of the track, and serves to latch the door in the open position. The downward locking movement of lower lock pin 72 is comtemporaneous with the upward locking movement of the upper lock pin 98 entering the opening keeper plate 111*e*, additionally securing the door is the open position.

During the movement of the door, the door panels 50 and 52 follow the path of the bottom tracks 58. Both panels are guided by respective rollers riding on these tracks. The upper portions of the doors 20 and 22 are stabilized by upper tracks 44 guiding the follower or yoke 122, fixedly attached to the outer flange 56 of the associated door.

Figure 6:
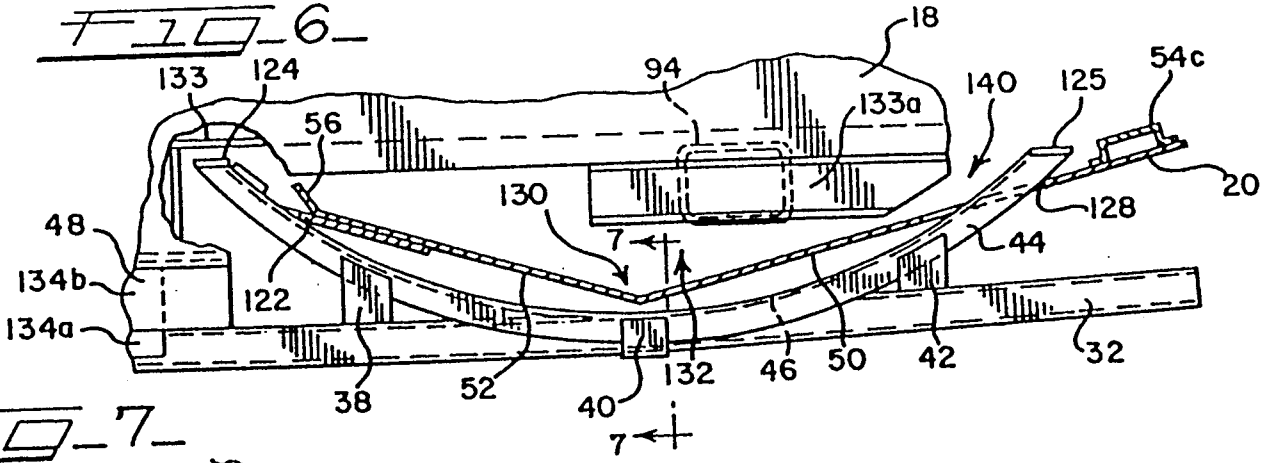
FIG. 6 is an enlarged view as in FIG. 4 showing the upper track structure.

The upper track 44, best shown in FIG. 6, is an arcuate portion of a circle and has inner and outer end stops 124 and 125, respectively, preventing movement of the yoke 122 and beyond the ends of track 44.

Figure 7:
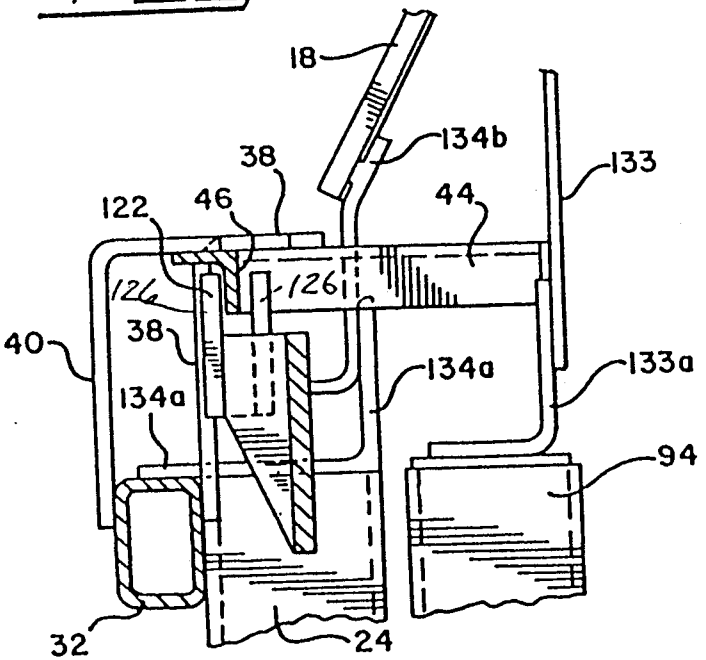
FIG. 7 is a cross-sectional view of the upper track taken along the line A—A in FIG. 7 and showing the yoke on the door at an intermediate location on the track.

As best visible in FIGS. 6 and 7, yoke 122 includes a pair of spaced lugs 126 receiving therebetween the downwardly depending flange 46 of track 44. When the door is closed, yoke 122 engages outer stop 125, and this braces the upper portion of the associated door against movement outwardly of the car.

When the door is opened, yoke 122 engages inner stop 124 to limit movment of the door beyond that point. Door inner panel 50 has a clearance opening 128 therein which receives the outward end of the upper track 44 to permit the door to be moved to fully uncover the end opening of the car.

When the door is open, the vertical end post 94 is within the inward facing recess generally indicated at 130 defined by the door panels 50 and 52. The door swings around this post 94 during movement between open and closed positions. The door moves within the space 132 defined by the vertical end post 94 and the side wall end portion 26. The location of the vertical posts 94 inwardly of the side walls allows for the movement of the door within the car and without undesirable openings in the side walls 12 and 14, while still complying with industry standards for lateral space in the car between the vertical posts 94 and also limits on the lateral width of the car.

As best shown in FIGS. 4, 6, 7 and 8, roof supporting structure 48 includes a longitudinally extending wall 133 connected with the roof of the car and with angle member 133*a* supported on vertical post 94. Post 24 supports angle member 134*a* secured in engagement with roof angle member 134*b*.

The doors and side walls are substantially coterminous with the outer edge 34 of the car. The corner structure 136 supports the ladder 28 and buttresses the car end structure. The door moves through the space 140 defined between the corner structure 136 and the end post 94 located inside the car until it reaches its fully open position determined by the bottom lock engagement with the floor-mounted keeper 88 and the yoke 122 abutment against the upper track end stop 125.

One of the advantages of the subject assembly is that the continuous side walls reinforce structural integrity of the car and offer greater protection from unauthorized entry than cars with openings in the side wall. Also, such walls prevent undesirable entry of dirt, mud and precipitation into the car. Also, the prior art cars having a slot in the side wall required a support bar to pass above the slot to support the longitudinally outer part of the wall. This support bar blocked movement of the upper part of the door. As a result, it was necessary to provide a slot in the door for clearance. This slot considerably weakened the upper door structure. The present invention, by providing for door movement entirely laterally inward of the side wall obviates the need for the clearance slot and results in a much stronger door structure.

Another advantage of the novel end closure is that the upper portion of the door is stabilized during the door movement by the upper track. The end stops of the upper track further improve support of the door in open and closed positions in the closed position, each door is supported at a plurality of points, i.e. the two lower roller assemblies, the lower pin 72, the upper pin 98, and the yoke 122 engaging stop 125. Outward movement of the inner edge of the door is also prevented by arm 59.

The above mentioned advantages are achieved without any functional or spatial sacrifice.

Figure 8:
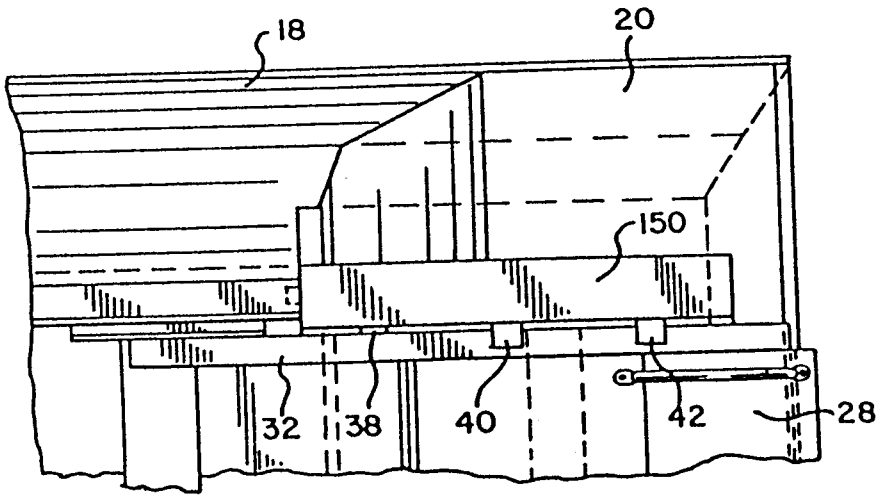
FIG. 8 show an elevational view of an alternate embodiment having a shield plate mounted adjacent the upper track.

The upper part of doors 20 extend vertically through an opening adjacent the upper track 44. As best shown in FIG. 8, to additionally protect the contents of the car against access through this opening when the doors 20 are closed, a shield plate 150 may be secured to the laterally outer surfaces of angles 38, 40, and 42.

The foregoing description and drawings merely illustrate the preferred embodiment and the invention is not limited thereto, except insofar as the appended claims are so limited as those skilled in the art who have the disclosure before them will be able to make modifications and variations therein without departing from the scope of the invention.

What is claimed is:

1. A railway car having a pair of longitudinal ends and comprising:

a generally horizontal floor structure;

first and second laterally spaced generally longitudinally extending side walls connected with the floor structure and extending generally upwardly therefrom;

said side walls extending substantially continuously between the ends of the car and defining an end opening therebetween at one of the ends of the railway car;

a generally vertical support post supported on said floor structure adjacent one of said side walls;

said support post being positioned laterally inwardly from said side wall and longitudinally inward from the end of the car, said support post and said side wall defining a space therebetween;

first guiding means supported on the floor structure and extending within said space;

a door movably supported on the first guiding means for movement between a closed position covering a portion of the opening and an open position wherein the door is positioned within the space between the support post and said one of the side walls whereby the railway car has substantially continuous side walls while permitting the placement of the door laterally outward of the support post when the door is in the open position, and a locking mechanism for securing the door in the closed position, said locking mechanism comprising;

a first lower keeper structure supported on the floor structure; and a first latch structure supported on the door and supporting a first latch member therein;

the keeper structure receiving the latch member therein for securing the door in the closed position, and said latch structure having biasing means urging the latch member downwardly;

said keeper structure comprising:

a receiving portion having an aperture therein receiving the latch member;

a ramp member connected with the receiving portion for cammingly elevating the latch member to the receiving portion as the door is moved to the closed position.

2. The invention according to claim 1, and keeper guide means supported on the receiving portion for guiding the latch member to the apeture when the door is moved to the closed position.

3. A railway car having a pair of longitudinal ends and comprising:

a generally horizontal floor structure;

first and second laterally spaced generally longitudinally extending side walls connected with the floor structure and extending generally upwardly therefrom;

said side walls extending substantially continuously between the ends of the car and defining an end opening therebetween at one of the ends of the railway car;

a generally vertical support post supported on said floor structure adjacent one of said side walls;

said support post being positioned laterally inwardly from said side wall and longitudinally inward from the end of the car, said support post and said side wall defining a space therebetween;

first guiding means supported on the floor structure and extending within said space;

a door movably supported on the first guiding means for movement between a closed position covering a portion of the opening and an open position wherein the door is positioned within the space between the support post and said one of the side walls whereby the railway car has substantially continuous side walls while permitting the placement of the door laterally outward of the support post when the door is in the open position, and upper and lower latch structures supported on the door;

upper and lower laterally inward keeper structures supported on the car;

said upper and lower latch structures coacting substantially synchronously with the upper and lower laterally inward keeper structures respectively to secure the door in the closed position;

upper and lower laterally outward keeper structures supported on the car;

said upper and lower latch structures coacting with said upper and lower laterally outward keeper structures when the door is in the open position to secure the door in said open position.

4. The invention according to claim 3, and said laterally inward keeper structures each having a recess therein;

said latch structures each having a pin member movably supported thereon, said pin members each being movable into and out of the recess in respective keeper structures;

said keeper structures limiting lateral movement of the pin members when the pin members are moved into the recess thereby latchingly securing the door in the closed position.

5. The invention according to claim 4, and connecting means connected with each of the pin members, said connecting means moving one of the pin members out of the recess in the associated keeper structure when the other of the pin members is moved out of the recess in the other of the keeper structures whereby both latch structures latch and release the door substantially synchronously.

6. A railway car having a pair of longitudinal ends and comprising:

a generally horizontal floor structure;

first and second laterally spaced generally longitudinally extending side walls connected with the floor structure and extending generally upwardly therefrom;

said side walls extending substantially continuously between the ends of the car and defining an end opening therebetween at one of the ends of the railway car;

a generally vertical support post supported on said floor structure adjacent one of said side walls;

said support post being positioned laterally inwardly from said side wall and longitudinally inward from the end of the car, said support post and said side wall defining a space therebetween;

first guiding means supported on the floor structure and extending within said space;

a door movably supported on the first guiding means for movement between a closed position covering a portion of the opening and an open position wherein the door is positioned within the space between the support post and said one of the side walls whereby the railway car has substantially continuous side walls while permitting the placement of the door laterally outward of the support post when the door is in the open position, a second post supported on the floor structure longitudinally inward from the support post;

a corner structure supported on the floor structure adjacent the end of the railway car and longitudinally outwardly from the support post;

said side wall connected with each said second post and said corner structure and extending substantially continuously therebetween to provide a substantially unbroken barrier to access to the interior of the railway car when the door is in the closed position, and a lock mechanism for securing the door in the closed position, said lock mechanism comprising:

upper and lower keeper structures supported on the railway car; and upper and lower latch structures supported on the door and coacting with respective keeper structures when the door is in the closed position to secure the door in the closed position whereby the door is supported on the car against longitudinally outward movement in the closed position by the support arm structure, the guide member, the follower structure engaging the stop structure, and the upper and lower latch structures engaging respective keeper structures for preventing unauthorized access to the interior of the car.

7. A railway car comprising:

a generally horizontal floor structure having a longitudinal end;

a side wall structure extending generally upwardly from the floor structure;

said side wall structure having an upper terminal end;

a canopy structure supported on the side wall structure, said canopy structure including a side wall connection portion being connected with the upper terminal end of the side wall structure, and extending generally upwardly and laterally inwardly therefrom;

said canopy structure further including an inset portion connected with the side wall connection portion and extending generally longitudinally outwardly therefrom, said inset portion being spaced laterally inwardly from the upper terminal end of the side wall structure;

said inset portion and the upper terminal end of the side wall structure defining a space between;

the floor structure, the side wall structure, and the canopy structure defining an opening therebetween adjacent the longitudinal end of the floor structure for providing access to the interior of the car for placing articles therein to be transported;

a door movably supported on the car;

guide means for guiding the door in movement between a closed position and an open position;

said door in the closed position extending over said opening to restrict access to the interior of the car;

said door in the open position extending within the space between the inset portion and the side wall structure, and said inset portion including a substantially vertical wall portion extending generally parallel to the side wall structure and spaced laterally inwardly therefrom, and a first post supported on the floor structure and extending generally upwardly therefrom;

said post being spaced laterally inwardly from the side wall structure and having a laterally inward end surface;

said post having connection means thereon connected with said inset portion of said canopy for the support thereof.

8. The invention according to claim 7, and said guiding means including an arcuate track member for guiding the door in a generally arcuate path between the closed and open position.

9. A railway car comprising:

a generally horizontal floor structure having wheels supported for rolling movement on a pair of tracks and having a longitudinal end;

a pair of laterally spaced longitudinally extending side walls supported on the floor structure and extending generally upwardly therefrom;

a canopy supported on the side wall structures and extending therebetween above the floor structure;

the floor structure, the side walls, and the canopy defining a cargo space therebetween and defining an opening adjacent the longitudinal end of the floor structure providing access to the cargo space;

a first post structure supported adjacent the longitudinal end on the floor structure and extending generally upwardly therefrom, said post structure being spaced laterally inward from one of the side walls;

a door structure supported adjacent the end of the floor structure for covering the opening to prevent entry therethrough;

said door structure including a door movably supported on the car, and guiding means for guiding the door in a generally arcuate path between a closed position wherein the door partially covers the opening, and an open position wherein the door is supported between said one of the side walls and said post structure and is withdrawn from the opening;

said one of the side walls having an upper terminal end portion;

the canopy including a side wall connection portion connected with the upper terminal end portion of the side wall inwardly of the car; and a laterally inset portion connected with the upper terminal end of the post structure and spaced inwardly from the upper terminal end portion of the side wall to define a gap therebetween the door in the open position extending through said gap;

the inset portion including a substantially vertical wall portion for securing the cargo space against entry.

* * * * *